United States Patent [19]

Simeone

[11] 4,236,499

[45] Dec. 2, 1980

[54] FIRE BOARD

[76] Inventor: Arthur Simeone, 66 Partridge La., Cherry Hill, N.J. 08033

[21] Appl. No.: 4,361

[22] Filed: Jan. 18, 1979

[51] Int. Cl.[3] ..... F24C 15/10

[52] U.S. Cl. ..... 126/140; 126/138; 126/139

[58] Field of Search ..... 126/138, 139, 140, 141, 126/142; D23/94, 97; 248/229; 292/258, 242, 295; 49/404

[56] References Cited

U.S. PATENT DOCUMENTS

| | | | |
|---|---|---|---|
| 622,565 | 4/1889 | Tharp | 126/140 |
| 1,606,112 | 11/1926 | Sutton | 126/140 |
| 1,670,995 | 5/1928 | Sutton | 126/138 |
| 2,398,240 | 4/1946 | Merryweather | 126/140 |
| 2,963,250 | 12/1960 | Bott et al. | 126/138 X |
| 3,260,257 | 7/1966 | Mason | 126/138 |
| 3,789,825 | 2/1974 | Reiner | 126/140 |
| 3,888,232 | 6/1975 | Le Brun | 126/140 |
| 3,989,213 | 11/1976 | Allen | 248/229 X |
| 4,036,205 | 7/1977 | Hayes | 126/140 X |
| 4,084,570 | 4/1978 | Rule et al. | 126/140 X |

FOREIGN PATENT DOCUMENTS

| | | | |
|---|---|---|---|
| 372619 | 3/1923 | Fed. Rep. of Germany | 292/295 |
| 608631 | 9/1948 | United Kingdom | 126/140 |
| 1118612 | 7/1968 | United Kingdom | 126/139 |

*Primary Examiner*—James C. Yeung
*Assistant Examiner*—Larry Jones
*Attorney, Agent, or Firm*—Thomas A. Lennox

[57] ABSTRACT

A fire board for covering a fire place opening provided with a clamp rigidly holding the fire board as a unitary structure with an L shaped strap to hold the fire board in position with a stop against the inside upper fire wall, when the draft is diminished.

22 Claims, 6 Drawing Figures

FIRE BOARD

BACKGROUND OF THE INVENTION

This invention is directed to the field of fireplace covers and the particular item is known as a fire board. Fire boards are useful items and have been used for centuries to cover the fire and still radiate heat into the building. The fire board of this invention is not intended to be used with a roaring fire, but rather after the fire has essentially died down and the family wishes to retire to other portions of the home. When the fire has died down leaving coals or smoldering logs, the flue must remain open or the gasses issuing from the coals will suffocate the inhabitants of the home. Dousing the fire with water is not effective to eliminate the noxious gasses and the flue must remain open until the coals are completely out and the vapors are no longer issuing from the remnants of the fuel. Without the use of this invention the heat from the home is allowed to escape up the chimney all night making the use of the fireplace prohibitively expensive in this day of rising fuel costs. The loss of heat up the chimney during the night more than offsets any savings from the fireplace during its use.

Prior fire boards do not fulfill the needs hereinabove or the objects described hereinabove. The original fire boards were of cast iron and intended to be left in place most of the time. Later fire boards are not collapsible or do not have the advantages of being held in position as in the present invention.

Typical fire boards constructed and designed to cover the fire and radiate heat are described in U.S. Pat. No. 176,363 to E. G. Schwarz, U.S. Pat. No. 419,064 to H. D. Peursell, U.S. Pat. No. 552,282 to W. E. Fitch, U.S. Pat. No. 624,984 to M. L. Scanlon, U.S. Pat. No. 1,475,886 to B. S. Rowe and U.S. Pat. Nos. 1,590,396 and 1,606,112 to J. H. Sutton. Typical fireplace fronts are described in U.S. Pat. No. 2,398,240 to G. Merryweather, et al, and U.S. Pat. No. 3,162,198 to T. C. Tompers. These fronts are typically faced with glass framed in metal. Such construction requires a substantial space between the glass and the metal to allow for the differences in the coefficients of thermal expansion between the glass and the metal. These spaces, totaled together provide for significant heat loss after the fire has died down. Such construction might have as many as 16 sides on the glass plates, adding up to as much as 40 lineal feet with a one-eighth inch opening. The heat loss up the chimney through these openings is substantial. More recently, fireplace closures have been described in U.S. Pat. No. 3,789,825 to L. O. Reiner and U.S. Pat. No. 3,888,232 to C. A. LeBrun. Neither of these devices provides the capabilities of collapsing for storage, provide attachment without marring the inside surface of the fireplace or satisfy the objects hereinbelow.

In U.S. Pat. No. 3,894,527, Ickes describes a cover for circulating fireplace registers to prevent thermal losses when the home is heated in the winter or during air-conditioned summer usage. The Ickes apparatus includes a plate supported over the fireplace by means of magnets.

These prior art units require special types of fireplace installations or require direct attachment to the fireplace or deface the fireplace in some fashion. None of these units provide for the fold-up, portability and ease of the attachment of the present invention.

It is therefore an object of this invention to provide a draft shield in the form of a fire board which will cover the fireplace opening.

It is a further object of this invention to provide a fireplace shield that may be folded up and easily stored away from the fireplace opening.

It is an additional object of this invention to provide a fire board with a holding means to hold the board in the opening after the draft is gone.

It is a further object of this invention that the holder not deface the fireplace opening in any way and touches the opening only on the inside of the firebox.

It is a further object of this invention that the connector be adapted to any size opening and any thickness of the face of the fireplace.

It is a particular object of this invention to provide a fire board type device to cover the opening of a fire place after the fire has essentially died down and is no longer needed.

It is a particular object of this invention to provide a fire board type device that will provide up to ninety-five percent efficiency in preventing warm air from rising up the chimney after the fire has essentially died down.

It is the object of this invention to provide a device that will be held against the hot fireplace as a result of the heat remaining in the fireplace but will remain affixed to the fireplace opening as the fire box cools and the draft disappears.

It is a further object of this invention to provide a fire board type device which may be left in place after the fire box has cooled completely, or may be removed and placed in storage for later use.

It is a further object of this invention to provide a fire board type device that prevents blow back from wind down the chimney blowing ashes into the home.

And finally, it is a most important object of this invention to provide a safety device which prevents coals from being ejected from the fire box into the home from glowing logs or other fuel after the inhabitants of the home have left the area of the fireplace.

These and other objects have been attained in the present invention which accomplishes the needs described hereinabove.

SUMMARY OF THE INVENTION

The above objects are accomplished by constructing a fire board for covering the fireplace opening. The fire board includes a sheet of metal, preferably at least two sheets of metal, generally aluminum sheets, which alone or when abutted edge to edge provide an area larger in all dimensions than the fireplace opening. A hinge system connects the abutted adjacent edges attaching them together along the edges while allowing the sheets to fold face to face. It is preferred that the fire board be of two sheets of metal of approximately equivelant size. A frame is rigidly connected around the periphery of the fire board with a break at any abutted edges to allow the sheets to fold. An inverted U shaped clamp is provided with at least one for each abutted edge pair fitting over the frame at the break and rigidly holding the adjacent sheet in a unitary structure in a planar configuration. On the side of the U shaped clamp nearest the fireplace opening a holding and sliding means is provided such that an L strap is held in position but may be slid horizontally along the surface of the clamp parallel with the fire board. The L shaped adjustable strap slides in that holder extending upwardly above the fire board in front of the fireplace face and horizontally into the fireplace opening behind the fire board. A vertical stop extends vertically from the horizontal extension of the L strap to engage the top inside surface of the fire box and typically the lintel bar, an angle iron support bar on the inside of the fireplace face holding up the first course of bricks. A knob or other hand holder extends horizontally from the vertical section of the L strap suitable to be grasped by the hand for vertical adjustment of the position of the L strap. When the fire board is placed in position in the opening, the L strap is pushed downwardly. After the fire board is in position, the L strap is pulled upwardly such that the stop engages the inside of the fire wall and holds the fire board in place after the draft ceases.

DESCRIPTION OF PREFERRED EMBODIMENTS

Throughout this specification and the claims, there is reference to the term "fire board". This term is intended as a generic description of the types of devices in which the present invention may be classified. It is not intended to suggest that the present invention is limited to the purposes and utility of the fireboards described in the prior art. In fact, the utility of the present invention is quite different from that of prior fire boards.

Figure 1:
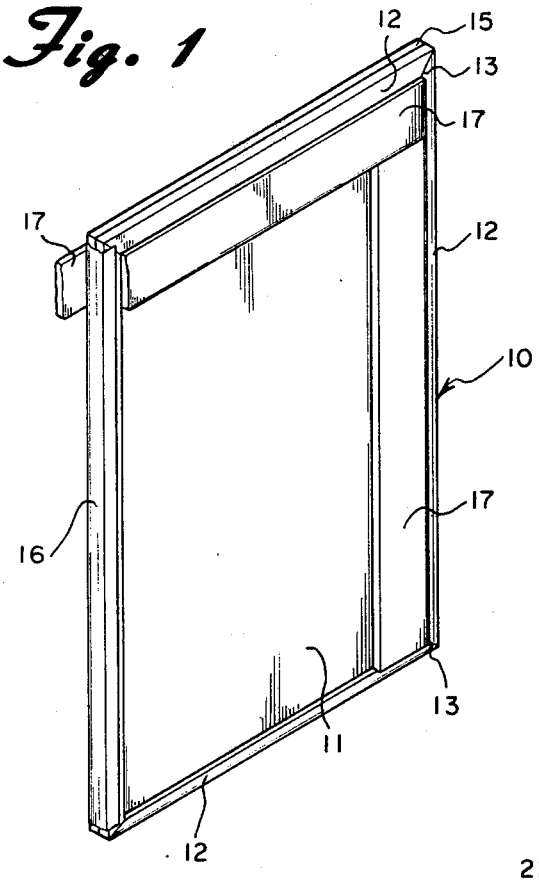
FIG. 1 is a perspective view of the fire board of this invention folded up for storage.

Fire board 10 of the present invention is pictured in FIG. 1 in perspective view folded up for storage. Fire board 10 is constructed of sheet 11, which is Reynold's Aluminum Company leather grain Number 602 mill finished 0.020 inches thick aluminum. Sheet 11 is reinforced by frame 12 constructed of Reynold's Number 6047 Silverlume molding fastened together at corners 13 with Reynold's Number 7210 corner locks. Second sheet 14 hidden in FIG. 1, is reinforced all around with frame 15 in the same fashion as frame 12. Sheets 11 and 14 are attached together with a continuous strip of 2 inch wide glass fiber tape 16. Attached in this fashion, tape 16 provides an effective hinge. Fiberglass batting 17 is adhesively attached to the inside surface of sheets 11 and 14 to provide an effective air seal against the fireplace facia.

Figure 2:
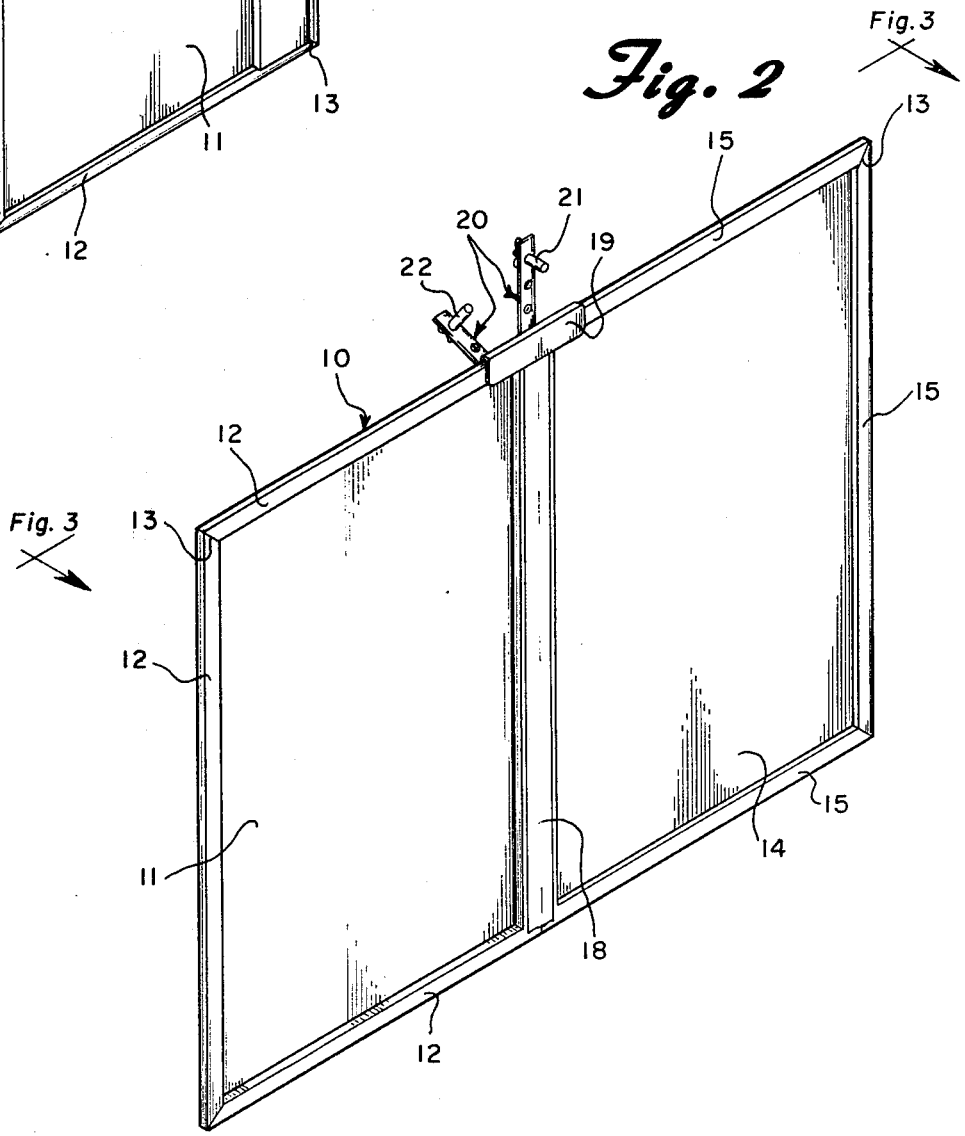
FIG. 2 is a perspective view of the fire board of this invention ready for installation in a fireplace opening.

In FIG. 2, fire board 10 is shown opened up and ready for installation into the fireplace opening. Sheet 11, reinforced by frame 12 forms a unitary structure with sheet 14 with frame 15. Three inch wide aluminum finish duct tape 18 reinforces the tape hinge 16. Framed sheets 11 and 14 are held in a plane by U clamp 19 on which strap 20 is attached. Knob 21 is pushed up or down raising or lowering strap 20 and vertical stop 22.

Figure 3:
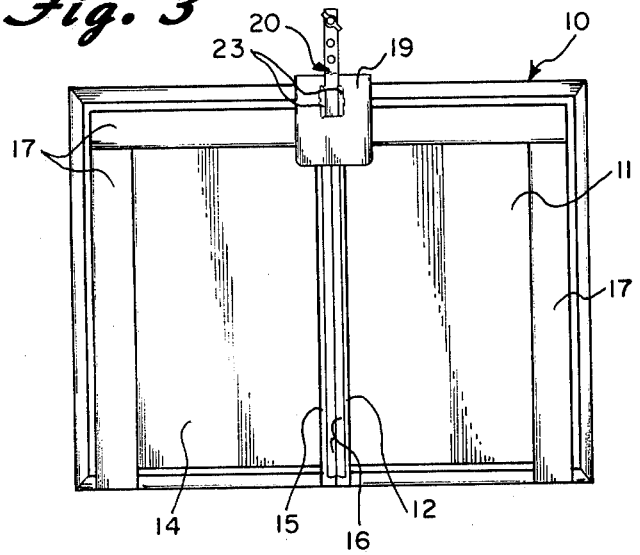
FIG. 3 is a rear elevational view of the fire board from inside the fireplace.

In FIG. 3 the rear view of fire board 10 shows sheets 11 and 14 held in position by U clamp 19 which extends vertically further behind the fire board than it does in the front. L strap 20 slides in vertically in holding guide 23. The edges of fiberglass tape hinge 16 are visible from this view as well as the edges of frame 12 and frame 15. Glass fiber batting 17 extends around the periphery of fire board 10 where it rests against the fireplace facia.

Figure 4:
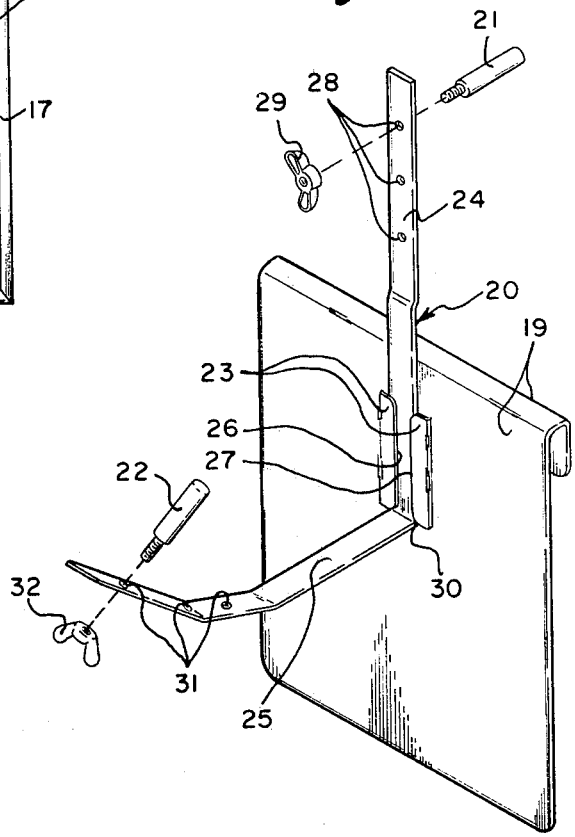
FIG. 4 is an exploded perspective view of the clamp system and strap holder to keep the fire board in the fireplace opening.

In FIG. 4 a close-up of L strap 20 is shown. L strap 20 is constructed ductile, spring stainless steel and includes vertical strap 24 and horizontal strap 25. Vertical strap 24 rides in between two facing louvered slots 26 and 27 cut in U clamp 19 to form guide holder 23. U clamp 19 is constructed of 0.30 inch aluminum sheet. Knob 21 is attached through any of holes 28 by wing nut 29. Horizontal strap 25 is shown slightly bent upwardly from the horizontal but it may also be merely angled at bend 30 to about 10° from the horizontal to aid in engagement of vertical stop 22 which is positioned in any of holes 31 with wing nut 32.

Figure 5:
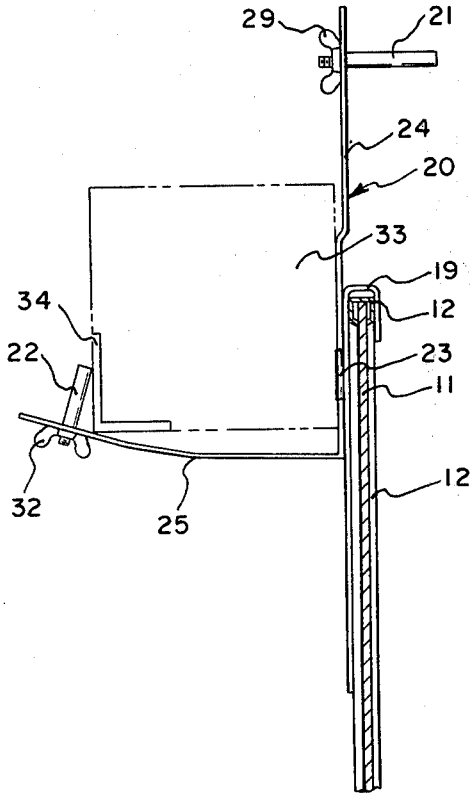
FIG. 5 is a partial cross-sectional view of the fire board and a side elevational view of the strap holder in position holding the fire board against the opening of the fireplace.

In FIG. 5 a partial cross-section of fire board 10 is shown held in place against brick facia 33 at the top of a fireplace opening. The edge of U clamp 19 is shown holding frame 12 in a rigid construction and L strap 20 in position to hold fire board 10 against brick facia 33. In this view, L strap 20 is in an uppermost position by lifting knob 21 to pull vertical strap 24 in guide holder 23 such that horizontal strap 25 approaches the bottom of brick facia 33 such that vertical stop 22 engages angle iron support bar 34 positioned on the inside of brick facia 33. In some fireplace constructions, this angle iron may not be reachable by stop 22 but in essentially all fireplace constructions there is an inside corner surface that stop 22 can engage to prevent fire board 10 from falling away from its position.

Figure 6:
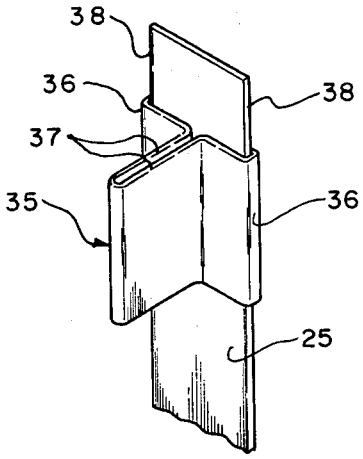
FIG. 6 is an expanded perspective view of a preferred embodiment of the stop on the end of the strap holder to engage the inside of the fireplace face.

In FIG. 6, a preferred vertical stop 35 is shown constructed of spring stainless steel sheet clamping around vertical strap 25 with vertical extensions 37 spring-loaded to hold at wrap around sections 36 against edges 38 of strap 25.

While I have described my invention in connection with specific embodiments, it is to be clearly understood that this description is made only by way of example and not as limitation to the scope of my invention as set forth in the following claims.

I claim:

1. A fire board for covering a fireplace, said fireplace including a firebox opening and resting against the face of the fireplace opening comprising (a) at least one sheet of metal which covers an area larger in all dimensions than the fireplace opening, (b) a frame means following the periphery of the metal sheet, (c) at least one inverted U shaped clamp means fitting over the frame means and the sheet, (d) a guide means on the U clamp means capable of holding and allowing a strap to slide up and down vertically on the side of the sheet nearest the fireplace opening, (e) an L shaped adjustable strap sliding vertically in the guide means extending upwardly above the top of the fire board between the fireplace face and horizontally into the fireplace opening, (f) a vertical stop extending vertically from the horizontal extension of the L strap to engage the inside of the firebox and, (g) a knob means extending horizontally from the vertically section of the L strap suitable to be grasped by the hand for vertical sliding of the L strap.

2. The fire board of claim 1 wherein glass fiber insulation is adhesively attached around the periphery of the fire board on the side of the fire board nearest the fire box.

3. The fire board of claim 1 wherein the strap is spring steel held in position by a facing pair of louvered slots in the U shaped clamp.

4. The fire board of claim 1 wherein the vertical stop is adjustable along the horizontal length of the L strap.

5. The fire board of claim 4 wherein the vertical strap comprises spring fold means around the edges of the strap to grip and slide along the strap and wherein the stop is of sufficient length that it binds when pressure is applied to the top of the stop and does not slide along the L strap.

6. The fire board of claim 1 wherein the knob means is adjustable to a height along the vertical portion of the L strap.

7. The fire board of claim 6 wherein the knob means is adjustable by means of a series of holes in the L strap in which the knob means may be bolted in various positions.

8. The fire board of claim 1 wherein there are (a) at least two sheets of metal which, when abutted edge to edge cover the area larger in all dimensions than the fireplace opening, (b) a hinge means between the abutted edges of the sheets attaching the sheets together along the edges and allowing the sheets to fold face to face, (c) the frame means has a break at the abutted edges of the sheets, and (d) the U shaped clamp means rigidly holds the adjacent sheets in a plane.

9. The fire board of claim 8 wherein each sheet is framed completely around its periphery.

10. The fire board of claim 8 wherein there are two aluminum sheets framed in aluminum.

11. The fire board of claim 8 wherein the hinge means is glass fiber tape on the abutting surfaces of the frames.

12. The fire board of claim 1 wherein the knob means is adjustable to a height along the vertical portion of the L strap.

13. The fire board of claim 12 wherein the knob means is adjustable by means of a series of holes in the L strap in which the knob means may be bolted in various positions.

14. A fire board for covering a fireplace, said fireplace including a firebox opening and resting against the face of the fireplace opening comprising (a) at least two sheets of metal which, when abutted edge to edge cover an area larger in all dimensions than the fireplace opening, (b) a hinge means between the abutted edges of the sheets attaching the sheets together along the edges and allowing the sheets to fold face to face, (c) a frame means following the periphery of the fire board with a break at the abutted edges of the sheet, (d) at least one inverted U shaped clamp means fitting over the frame means at the break in the frame means rigidly holding the adjacent sheets in a plane, (e) a guide means on the U clamp capable of holding and allowing a strap to slide up and down vertically on the side of the sheets nearest the fireplace opening, (f) an L shaped adjustable strap sliding vertically in the guide means extending upwardly above the top of the fire board between the fireplace face and horizontally into the fireplace opening, (g) a vertical stop extending vertically from the horizontal extension of the L strap to engage the inside of the firebox and (h) a knob means extending horizontally from the vertical section of the L strap suitable to be grasped by the hand for vertical sliding of the L strap.

15. The fire board of claim 14 wherein each sheet is framed completely around its periphery.

16. The fire board of claim 14 wherein there are two aluminum sheets framed in aluminum.

17. The fire board of claim 14 wherein the hinge means is glass fiber tape on the abutting surfaces of the frames.

18. The fire board of claim 14 wherein fiber glass insulation is adhesively attached around the periphery of the fire boare on the side of the fire board nearest the fire box.

19. The fire board of claim 14 wherein the strap is spring steel held in position by a facing pair of louvered slots in the U shaped clamp.

20. The fire board of claim 14 wherein the vertical stop is adjustable along the horizontal length of the L strap.

21. The fire board of claim 20 wherein the vertical strap comprises spring fold means around the edges of the strap to grip and slide along the strap and wherein the stop is of sufficient length that it binds when pressure is applied to the top of the stop and does not slide along the L strap.

22. A fire board for covering a fireplace, said fireplace including a firebox opening and resting against the face of the fireplace opening around the edges of the opening comprising (a) two sheets of metal, (b) frame means around the periphery of each sheet rigidifying and supporting the sheet, which together, when abutted edge to edge cover an area larger in all dimensions than the fireplace opening, (c) a hinge means comprising a tape across the abutted edges of the frames attaching the framed sheets together and allowing the sheets to fold face to face, (d) an inverted U shaped spring clamp means fitting over the upper edge of the frame means of both sheets at the upper end of the abutted edges rigidly holding the sheets in a plane, (e) an L shaped adjustable strap, (f) a guide means on the side of the U clamp nearest the fireplace opening capable of holding and allowing the L strap to slide up and down vertically on the side of the sheet nearest the fireplace opening, wherein the L strap extends upwardly above the top of the fire board between the fireplace face and the side of the U clamp nearest the opening and wherein the L shaped strap extends horizontally into the fireplace opening behind the fire board, (g) a vertical stop extending extending vertically from the horizontal portion of the L strap of sufficient height to engage the inside of the fire box of the fireplace and (h) a knob means adjustable to various positions on the vertical section of the L strap graspable by the hand for vertical sliding of the L strap into position.

* * * * *